US007467934B2

(12) United States Patent
Thoms et al.

(10) Patent No.: US 7,467,934 B2
(45) Date of Patent: Dec. 23, 2008

(54) AXIAL PISTON ENGINE WITH INTEGRATED FILLING PUMP

(75) Inventors: Reinhardt Thoms, Neumunster (DE); Carsten Fiebing, Jevenstedt (DE)

(73) Assignee: Sauer-Danfoss, Inc., Ames, IA (US)

( * ) Notice: Subject to any disclaimer, the term of this patent is extended or adjusted under 35 U.S.C. 154(b) by 254 days.

(21) Appl. No.: 11/141,416

(22) Filed: May 31, 2005

(65) Prior Publication Data

US 2006/0051229 A1 Mar. 9, 2006

(30) Foreign Application Priority Data

Sep. 6, 2004 (DE) ..... 10 2004 043 018

(51) Int. Cl.
*F01C 1/02* (2006.01)
*F01C 1/063* (2006.01)

(52) U.S. Cl. ..... 418/61.3; 418/61.1; 418/57

(58) Field of Classification Search ..... 418/132, 418/133, 61.3, 171, 166
See application file for complete search history.

(56) References Cited

U.S. PATENT DOCUMENTS 3,695,791 A * 10/1972 Brundage ..... 418/131
4,199,305 A * 4/1980 Pareja ..... 417/440
5,354,180 A * 10/1994 Forster ..... 417/199.1
2005/0063851 A1* 3/2005 Phillips ..... 418/61.3

FOREIGN PATENT DOCUMENTS

WO PCT/US02/39812 * 12/2002

* cited by examiner

*Primary Examiner*—Thomas Denion
*Assistant Examiner*—Douglas J. Duff

(57) ABSTRACT

The invention relates to an axial piston engine with a filling pump integrated in a receiving bore of the axial piston engine, which filling pump comprises a gerotor set with an externally toothed inner ring and an internally toothed outer ring and also an inner thrust plate and an outer thrust plate. The two thrust plates enclose the gerotor set between them and, on their surfaces facing away from the gerotor set, are in each case supported via a pressure field seal, which surrounds the pressure field regions formed in the thrust plates, in such a way on the housing walls axially enclosing the filling pump that lateral play in the form of axial mobility of the filling pump is guaranteed.

16 Claims, 3 Drawing Sheets

AXIAL PISTON ENGINE WITH INTEGRATED FILLING PUMP

BACKGROUND OF THE INVENTION

The invention relates to an axial piston engine with a filling pump integrated in a receiving bore of the axial piston engine and the features according to Claim 1.

To compensate for internal leakage losses and the oil quantities deliberately taken out for cooling and for filtering, closed-circuit hydraulic pumps require what is known as a filling pump, which is as a rule attached to the end housing or integrated into it as an auxiliary pump.

Various types of pump can be used as a filling pump. Internal gear pumps, for example, which offer the advantage that the main shaft of the axial piston engine can be guided through the filling pump even in the case of a great shaft diameter, the main shaft at the same time driving the filling pump as well, are suitable. The drive of the filling pump can also be designed in such a way that the filling pump has its own shaft with separate bearing, which is in turn driven by the main shaft.

All constructions have essentially two problems to contend with: on the one hand, the unavoidable operating forces acting on the shaft lead to the latter being shifted out of its optimum position, elastic deformations of the shaft moreover arising, owing to which constraining forces are in each case exerted on the filling pump. These constraining forces caused by shaft shifts and shaft deformations have to be kept away from the filling pump to the greatest extent possible as otherwise they also load its parts radially and axially, displace them and possibly even misalign them, which results in increased wear and can lead to failure of the filling pump. On the other hand, the lateral play of the filling pump and also the evenness, surface structure and machining or coating of the walls axially delimiting the filling pump have a great influence on its volumetric efficiency and its reliable functioning. This results in manufacturing being highly complex and especially difficult to effect in practice when these walls are to be fashioned in the pump housing itself.

Conventionally, the filling pump is therefore in many cases built into a separate, unilaterally open housing in pot form with a very accurately executed bore depth for the lateral play tolerance. This housing together with the filling pump is then inserted into the end housing as a subassembly. The construction requires a great deal of construction space and is expensive. The construction space requirement is due to inter alia the necessary rigidity of the filling pump housing against deformation caused by the operating pressures and the forces exerted by the necessary fastening bolts. Above all, involved sealing of the entire construction is necessary as well.

By means of the invention, an axial piston engine with a compact filling pump which requires low component rigidity is to be produced.

This object is achieved with an axial piston engine according to Claim 1.

SUMMARY OF THE INVENTION

According to the invention, a filling pump is integrated in a receiving bore in the axial piston engine, which filling pump comprises a gerotor set with an externally toothed inner ring and an internally toothed outer ring and also an inner thrust plate and an outer thrust plate which enclose the gerotor set between them. On their surface facing away from the gerotor set, the thrust plates are in each case supported via a pressure field seal in such a way on the housing walls axially enclosing the filling pump that lateral play in the form of axial mobility of the filling pump is guaranteed. In this connection, the pressure field seals surround in each case at least one pressure field region formed in the thrust plates.

A bearing ring is preferably provided, which is mounted in the receiving bore of the axial piston engine and surrounds the internally toothed outer ring of the gerotor set. This bearing ring can have the same width as the gerotor set, so that the thrust plates are supported on the gerotor set and the axial play appears only when the filling pump is in operation due to the hydrodynamic forces which occur. However, in another embodiment of the invention, the bearing ring can also be wider than the gerotor set and space the thrust plates in such a way that a fixed axial play is defined between the gerotor set and the thrust plates on both sides. In this connection, the bearing ring can be designed concentrically with the same axis for inside diameter and outside diameter or eccentrically with axes offset in a parallel manner for inside diameter and outside diameter.

It is advantageous if the diameter of the receiving bore is dimensioned to be slightly larger than the outside diameter of the bearing ring, because the filling pump thus has a radial play and can accordingly avoid radial constraining forces.

The pressure field seal surrounding the pressure opening in the thrust plates is preferably of approximately kidney-shaped design, the said seal sealing a first pressure field. It is advantageously supplemented on the suction side by a further pressure field seal on a second pressure field to form a seal encompassing the entire periphery of the thrust plate. This further pressure field seal is of essentially semi-circular design, it being particularly advantageous if the kidney-shaped pressure field seal on the pressure side and the semi-circular pressure field seal on the suction side are designed in one piece and thus include both pressure fields.

The thrust plates are preferably of mirror-symmetrical design and have grooves for attachment of the pressure field seals. If in this connection the pressure field seals are designed symmetrically in relation to their central plane, the advantage is obtained that the same seals can be used on both sides of the filling pump, because the pressure field seals can then be inserted into the groove of the thrust plate with on the one hand their right and on the other hand their left shoulder.

In another preferred development, the pressure field seals have knobs with which they are secured in the grooves of the thrust plates.

According to the invention, for lubrication purposes, the thrust plates have on the surface in each case facing the gerotor set grooves extending outwards from the pressure opening in order to convey pressure oil to the radial gap between the bearing ring and the internally toothed outer ring of the gerotor. In the same way, grooves extending outwards from the suction opening are provided in order to convey pressure oil away from the radial gap between the bearing ring and the internally toothed outer ring of the gerotor again. At least one further groove extends radially inwards from the suction opening, in order that oil can also be conveyed out of the space surrounded radially by the filling pump and returned into the circulation.

In a preferred embodiment, the thrust plates have means with which their position relative to the wall radially surrounding the filling pump can be fixed, for example by virtue of the thrust plates having one or more projections which engage in recesses of the wall radially surrounding the filling pump.

Further details and features of the invention emerge from the following description of the illustrative embodiments.

DETAILED DESCRIPTION OF THE PREFERRED EMBODIMENT

Figure 1:
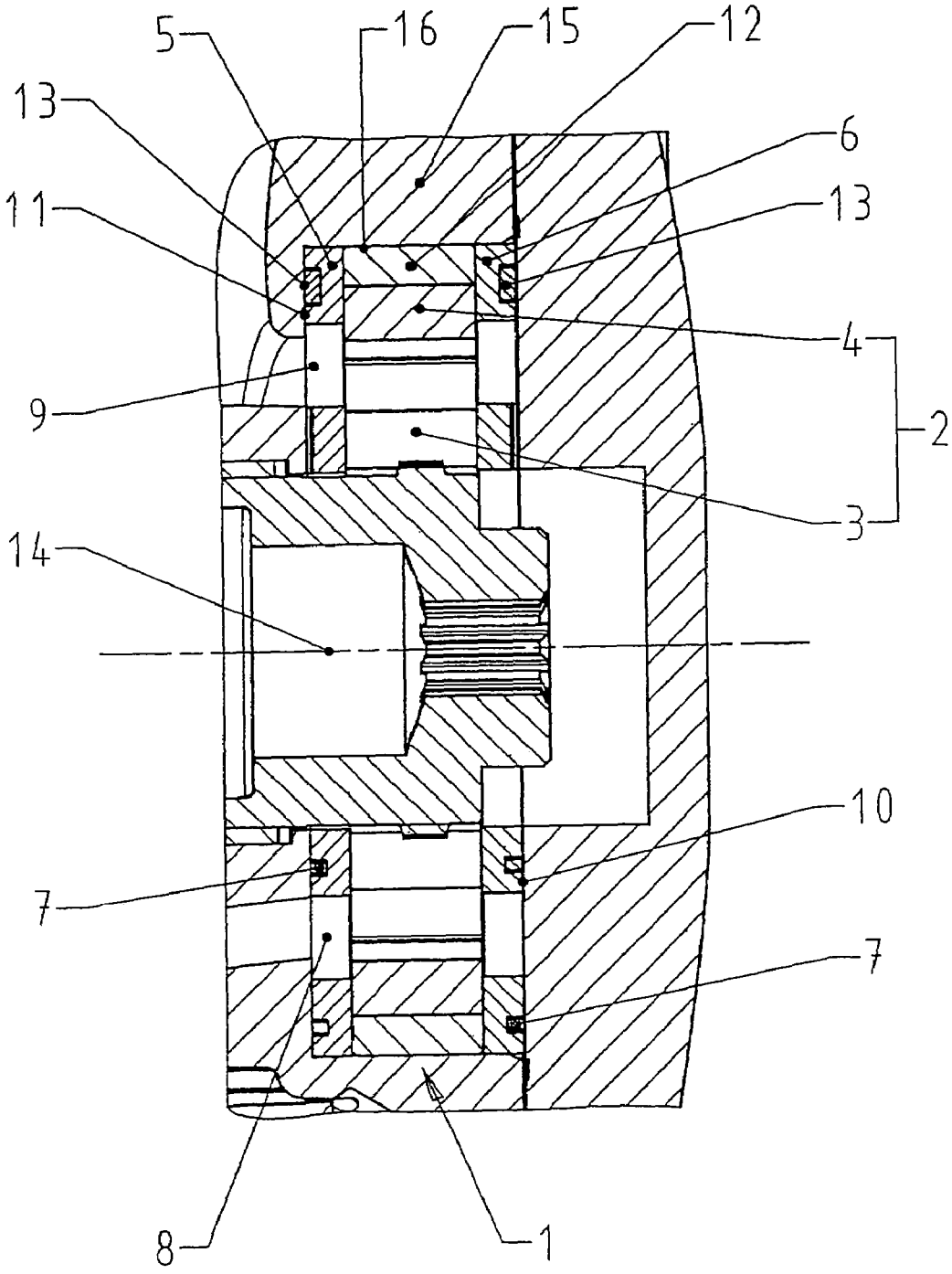
FIG. 1 shows a filling pump according to the invention built into the end housing of an axial piston engine.

FIG. 1 shows the filling pump 1 according to the invention, which is built into the end housing 15 of an axial piston engine. The filling pump 1 comprises a gerotor set 2 with an externally toothed inner ring 3 and an internally toothed outer ring 4, which rings are driven by the main shaft 14 of the axial piston engine. The gerotor set 2 is mounted in a bearing ring 12 which surrounds the gerotor set 2 externally and is inserted into a receiving bore 16 of the axial piston engine. In this connection, the bearing ring 12 surrounds the internally toothed outer ring 4 of the gerotor set 2 and thus forms the radial bearing of the filling pump.

Arranged on the two sides of the gerotor set 2 and of the bearing ring 12 are an inner thrust plate 5 and an outer thrust plate 6 with kidney-shaped suction and pressure openings 8, 9, which rings have pressure field seals 7, 13 on their sides facing away from the gerotor set. In this connection, the pressure field seal 7 surrounds, in a first pressure field, the kidney-shaped pressure opening 8 with essentially two roughly semicircular segments, one of which follows the outer periphery of the thrust plate, while the other seals the pressure opening towards the interior. The pressure field seal 13 provided for the suction-side pressure field extends in an essentially semi-circular shape along the periphery of the thrust plates 5, 6 and supplements the outer semi-circle of the pressure-side pressure field seal 7 to form a sealing ring surrounding the thrust plate over its entire periphery. The pressure field seals 7, 13 consequently on the one hand surround the pressure opening 8 and on the other hand seal the outer edge of each thrust plate 5, 6. Via the pressure field seals 7, 13, the thrust plates 5, 6 are supported in such a way on the housing walls 10, 11 axially enclosing the filling pump that lateral play in the form of axial mobility of the filling pump is guaranteed.

Figure 2:
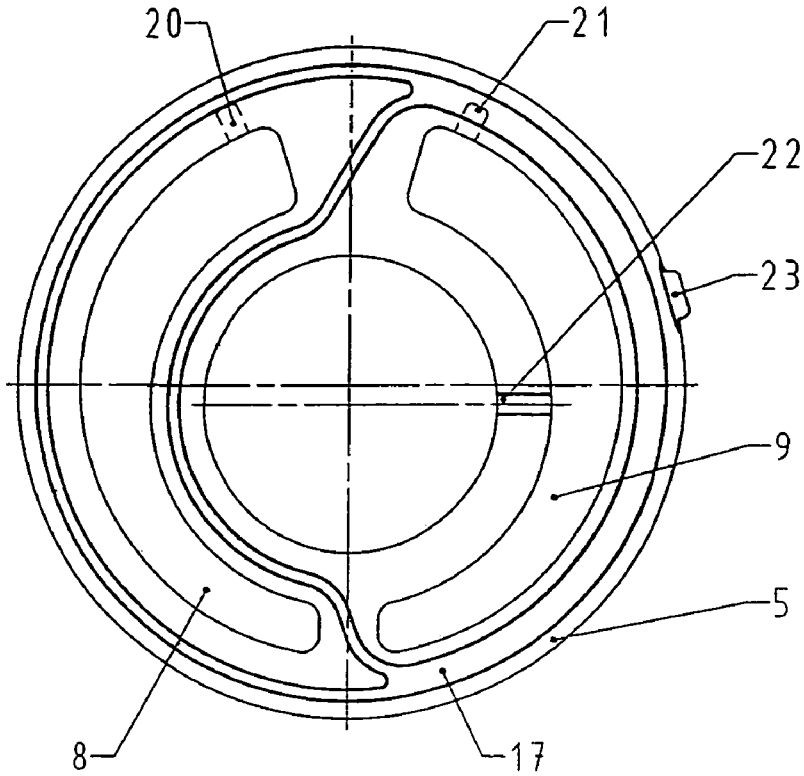
FIG. 2 shows the thrust plates according to FIG. 1, in each case seen from their side facing away from the gerotor set.
Figure 2:
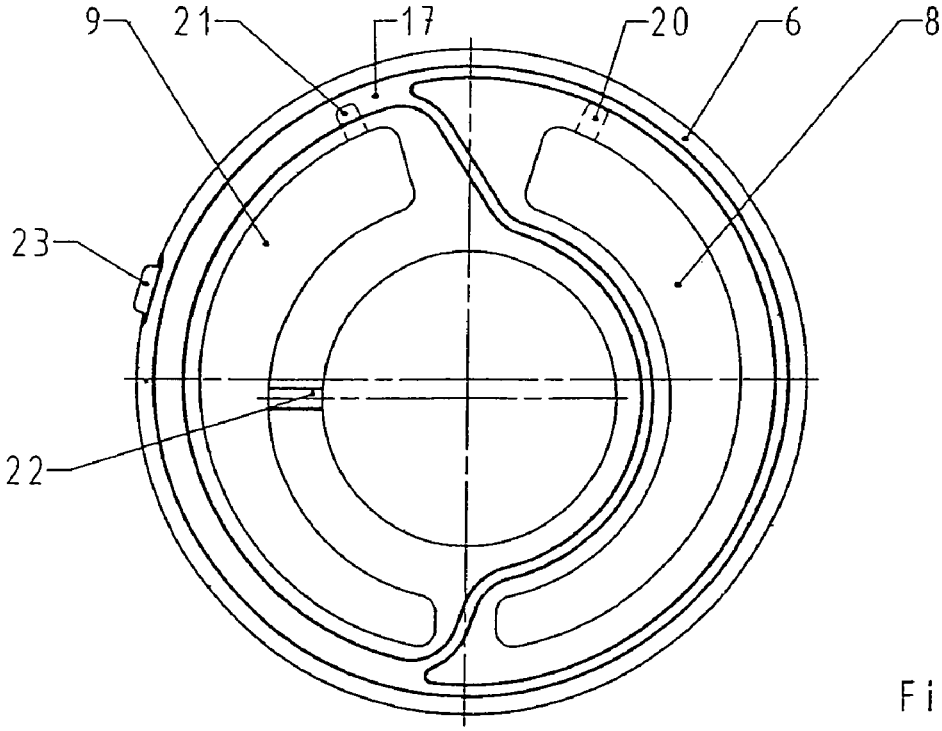

FIG. 2 shows the thrust plates 5, 6 in each case seen from their side facing away from the gerotor set 2. Formed in the thrust plates 5, 6 are kidney-shaped pressure openings 8 and suction openings 9 and also grooves 17 which receive the pressure field seals 7, 13, 18. The pressure field seals 7, 13, 18 can have webs or knobs, for example, designed on them, with which they are secured in the grooves 17. In another embodiment, the pressure field seals 7, 13, 18 are designed symmetrically in relation to their central plane and are inserted into the grooves 17 of the thrust plates on the one hand with their right and on the other hand with their left shoulder.

Means, with which the installation position of the thrust plates is fixed, are provided on the outer periphery of the thrust plates 5, 6. For this purpose, in the example shown, one or more projections 23 are provided, which engage in recesses of the receiving bore 16, as a result of which the position of the thrust plates is fixed.

Further grooves 20 extending radially outwards from the pressure opening 8 are formed in each case in that surface of the thrust plates 5, 6 facing the gerotor 2 in order, for lubrication purposes, to make passage of pressure oil possible to the radial gap between the bearing ring 12 and the internally toothed outer ring 4 of the gerotor. In the same way, grooves 21 in each case lead outwards from the suction opening 9 in order to convey pressure oil, together with any abraded material arising, away from this radial gap again. At least one further groove 22 leads inwards from the suction opening 9 and serves for drainage of the filling pump environment in order to convey oil out of the space surrounded radially by the filling pump. In this way, the oil branched off from the filling pump for lubrication or flowing out unintentionally is supplied to the circulation again.

The thrust plates 5, 6 are formed in a mirror-inverted way on the two sides of the gerotor, so that, in the projection direction along the shaft 14, the pressure field seals lie exactly on top of one another and are congruent.

Figure 3:
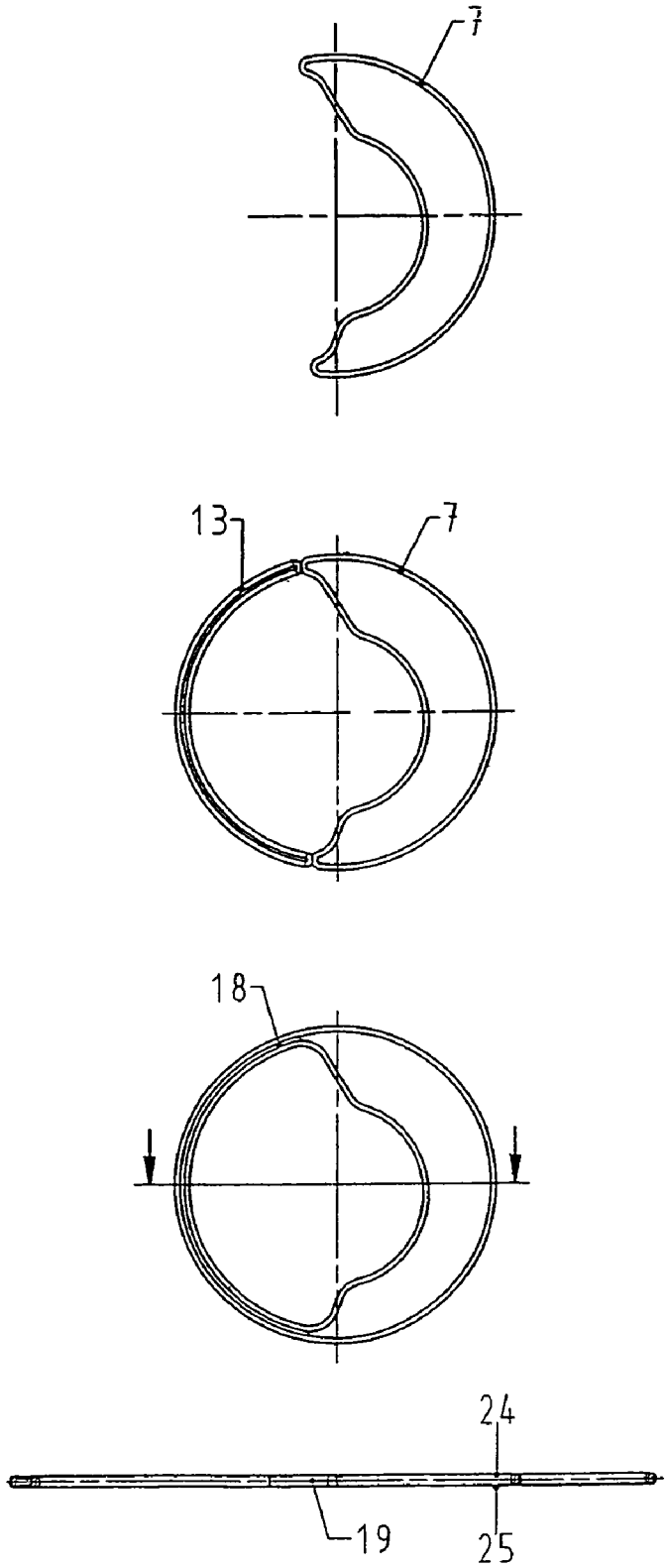
FIG. 3 shows associated pressure field seals.

FIG. 3 shows embodiments of the pressure field seals 7, 13, 18. In the top illustration, the pressure field seal 7 surrounds a first pressure field. This seal is essentially of kidney-shaped design and surrounds the region of the pressure opening 8.

In the example of the second illustration, the seal is in two parts. It comprises a first part 7, which surrounds the region of the pressure opening 8 of the thrust plates 5, 6, and an essentially semi-circular part 13 lying in the region of the suction side, which supplements the arc of the seal 7 running around at the outer edge of the thrust plates in such a way that both the pressure field lying on the suction side and centrally and the thrust plate as a whole are sealed towards the outside.

A one-piece embodiment 18 of this pressure field seal is shown in the third illustration in FIG. 3.

In this connection, it is advantageous if the pressure field seals are symmetrical in relation to their central plane 19, as illustrated at the bottom in FIG. 3, where the pressure field seal is shown from the side and the central plane 19 is defined. In this case, the same seals can be used on both sides of the filling pump, being placed into the groove 17 of the thrust plates with on the one hand the right 25 and on the other hand the left shoulder 24.

The pressure field seals described above act in a gap-bridging way. This results in high volumetric efficiency, because leakage from the pressure-conveying regions is to a great extent prevented, although a noticeable axial gap is allowed. At the same time, the complexity of machining the receiving bore 16 is reduced, because no strict requirements have to be met as far as depth and surface finish are concerned.

The pressure field seals are dimensioned in such a way that the operating pressures acting on the thrust plates are balanced out and virtually no deformation of the thrust plates occurs. As direct mechanical contact is avoided by means of the flexible seals, the transmission of constraining forces to the thrust plates is prevented to the greatest possible extent. The axial play made possible in this way can to a certain extent also cope with misalignments of the filling pump without damage.

The diameter of the receiving bore 16 in the end housing 15 of the axial piston engine for the bearing ring 12 forming the radial bearing of the filling pump can be selected to be slightly larger than the outside diameter of the bearing ring and dimensioned in such a way that on the one hand it is possible for the filling pump to move away without damage in the event of radial displacement due to constraining forces of the shaft but on the other hand this radial play of the filling pump does not generate any discernible volumetric effect.

The thrust plates 5, 6 are supported directly on the gerotor set 2. The axial play between the gerotor set and the thrust plates 5, 6 appears only when the pump is in operation due to the hydrodynamic and hydrostatic forces which occur. However, in another embodiment, the bearing ring 12 enclosed by the thrust plates 5, 6 can also be made in such a way that it is slightly wider than the gerotor 2, so that the thrust plates 5, 6 have a fixed axial play in relation to the gerotor set.

For a change in the direction of rotation of the main shaft of the axial piston engine, the receiving bore, which always lies eccentrically in relation to the main shaft in the case of gerotors and internal gear pumps, is to be bored with, the opposite alignment in relation to the main shaft. Then, using the same parts, a filling pump for a changed direction of rotation can be assembled, the outer thrust plate simply having to be exchanged for the inner.

The thrust plates according to the invention can be manufactured by sintering or fine blanking, for example, so that different thicknesses can be manufactured with the same tool, by virtue of which, in combination with gerotor thicknesses, filling pumps with different delivery volumes can be produced with the same depth of the receiving bore in the end housing.

What is claimed is:

1. Axial piston engine with a filling pump (1) integrated in a receiving bore (16) of the axial piston engine, which filling pump comprises a gerotor set (2) with an externally toothed inner ring (3) and an internally toothed outer ring (4) and also an inner thrust plate (5) and an outer thrust plate (6) which enclose the gerotor set (2) between them and, on their surfaces facing away from the gerotor set (2), are in each case supported via a plurality of pressure field seals (7, 13), which in each case surround at least one pressure field region formed in the thrust plates (5, 6), in such a way on the housing walls (10, 11) axially enclosing the filling pump (1) that lateral play in the form of axial mobility of the filling pump (1) is guaranteed; wherein the inner thrust plate and the outer thrust plate each have grooves (17) disposed therein for receiving the pressure field seals; wherein the pressure field seals engage an end housing of the axial piston engine (15) and the housing walls (10, 11); wherein a first pressure field seal (7) is essentially kidney-shaped and surrounds a pressure opening (8) in the thrust plates (5, 6) sealing a first pressure field; and wherein a second pressure field seal (13) is essentially semi-circular and surrounds a second pressure field; wherein the second pressure field seal (13) supplements the first pressure field seal (7) to form a seal running around the periphery of the thrust plate.

2. Axial piston engine according to claim 1, a bearing ring (12) being provided, which is mounted in the receiving bore (16) of the axial piston engine and surrounds the internally toothed outer ring (4) of the gerotor set (2).

3. Axial piston engine according to claim 2, the bearing ring (12) having the same width as the gerotor set (2) and the thrust plates (5, 6) being supported on the gerotor set (2).

4. Axial piston engine according to claim 2, the bearing ring (12) being wider than the gerotor set (2) and spacing the thrust plates (5, 6) in such a way that a fixed axial play is defined between the gerotor set (2) and the thrust plates (5, 6) on both sides.

5. Axial piston engine according to claim 2, the bearing ring (12) being designed concentrically with the same axis for inside diameter and outside diameter.

6. Axial piston engine according to claim 2, the bearing ring (12) being designed eccentrically with axes offset in a parallel manner for inside diameter and outside diameter.

7. Axial piston engine according to claim 2, the diameter of the receiving bore (16) being larger than the outside diameter of the bearing ring (12) in such a way that radial play of the filling pump is made possible.

8. Axial piston engine according to claim 1, the thrust plates (5, 6) having on the surface in each case facing the gerotor set (2) grooves (20) extending outwards from the pressure opening (8) in order to convey pressure oil to the radial gap between the bearing ring (12) and the internally toothed outer ring (4) of the gerotor (2).

9. Axial piston engine according to claim 1, the thrust plates (5, 6) having on the surface in each case facing the gerotor set (2) grooves (21) extending outwards from a suction opening (9) in order to convey pressure oil away from the radial gap between the bearing ring (12) and the internally toothed outer ring (4) of the gerotor (2).

10. Axial piston engine according to claim 1, the essentially kidney-shaped pressure field seal (7) and the further pressure field seal (13) forming a one-piece pressure field seal (18) which includes both pressure fields.

11. Axial piston engine according to claim 1, the pressure field seals (7, 13, 18) being designed symmetrically in relation to their central plane (19).

12. Axial piston engine according to claim 10, the pressure field seals (7, 13, 18) having knobs with which they can be fastened in the thrust plates (5, 6).

13. Axial piston engine according to claim 1, the thrust plates (5, 6) being of mirror-symmetrical design.

14. Axial piston engine according to claim 1, the thrust plates (5, 6) having grooves (22) extending radially inwards from the suction opening (9) in order to convey oil out of the space surrounded radially by the filling pump.

15. Axial piston engine according to claim 1, the thrust plates (5, 6) having means with which their position relative to the wall, in the receiving bore (16), radially surrounding the filling pump can be fixed.

16. Axial piston engine according to claim 15, the thrust plates (5, 6) each having at least one projection (23) which engages in recesses of the wall radially surrounding the filling pump.

* * * * *